US006035928A

United States Patent [19]

Ruppel et al.

[11] Patent Number: 6,035,928

[45] Date of Patent: Mar. 14, 2000

[54] FIN TUBE BLOCK FOR A HEAT EXCHANGER AND METHOD OF MAKING SAME

[75] Inventors: Wolfgang Ruppel, Bad Wildbad; Günther Schmalzried, Korb; Rolf Sieber, Mühlacker, all of Germany

[73] Assignee: Behr Industrietechnik GmbH & Co., Stuttgart, Germany

[21] Appl. No.: 08/955,154

[22] Filed: Oct. 21, 1997

[30] Foreign Application Priority Data

Oct. 26, 1996 [DE] Germany ..... 196 44 586

[51] Int. Cl.[7] ..... F28D 1/02

[52] U.S. Cl. ..... 165/153; 165/81; 165/177; 165/152

[58] Field of Search ..... 165/152, 177, 165/153, 81, 171

[56] References Cited

U.S. PATENT DOCUMENTS

| | | | |
|---|---|---|---|
| 3,679,531 | 7/1972 | Wienand et al. | 165/177 X |
| 4,703,597 | 11/1987 | Eggemar | 165/171 X |
| 5,033,540 | 7/1991 | Tayehami et al. . | |
| 5,307,870 | 5/1994 | Kamiya et al. . | |
| 5,372,188 | 12/1994 | Dudley et al. | 165/152 X |
| 5,476,141 | 12/1995 | Tanaka . | |
| 5,671,806 | 9/1997 | Schmalzried | 165/152 X |

FOREIGN PATENT DOCUMENTS

| | | |
|---|---|---|
| 2342787A1 | 3/1975 | Germany . |
| 3524444A1 | 8/1986 | Germany . |
| 4120442A1 | 12/1992 | Germany . |

OTHER PUBLICATIONS

Search Report Feb. 14, 1997 Germany.

*Primary Examiner*—Christopher Atkinson
*Attorney, Agent, or Firm*—Evenson, McKeown, Edwards & Lenahan, P.L.L.C.

[57] ABSTRACT

A fin-tube block and method of making a fin tube block for heat exchangers is disclosed. Tubes provided for the through-flow of the coolant are manufactured as adjacent channels in an extruded section with a plate shape and then stacked on one another, alternating with corrugated ribs and additional extruded sections in a packet assembly and then soldered.

8 Claims, 2 Drawing Sheets

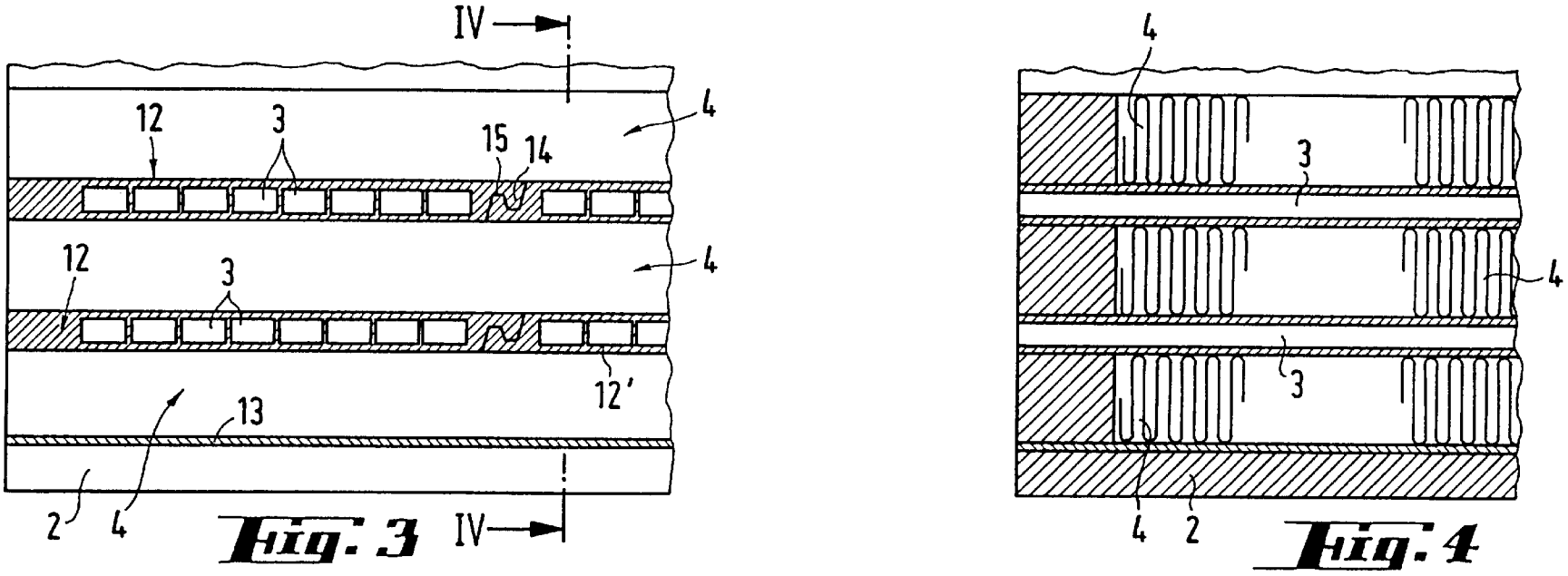
Fig. 4
Fig. 3
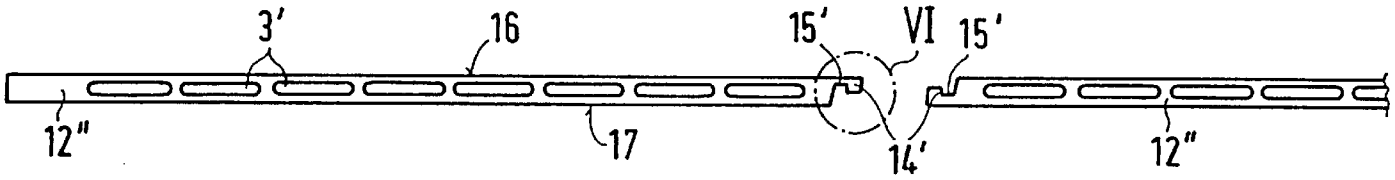
Fig. 5
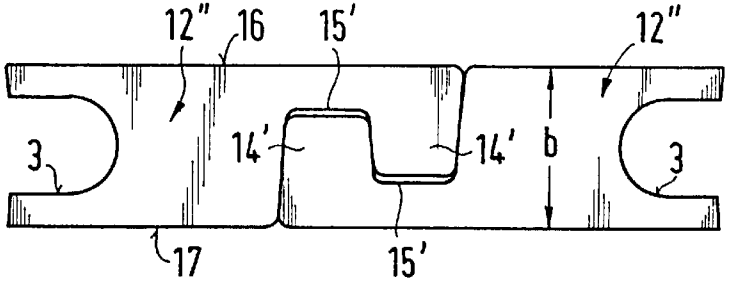
Fig. 6

FIN TUBE BLOCK FOR A HEAT EXCHANGER AND METHOD OF MAKING SAME

BACKGROUND AND SUMMARY OF THE INVENTION

This application claims the priority of German application 196 44 586.8 filed in Germany of Oct. 26, 1996, the disclosure of which is expressly incorporated by reference herein.

The invention relates to a fin-coil block for a heat exchanger, especially a charge air cooler that has tubes running parallel to one another and fin-type corrugated ribs through which air flows being located between the tubes, the block being mounted in a rigid frame that consists of two water tanks surrounding the open ends of the tubes and of two side parts connecting these tanks.

Fin-coil blocks of this type are generally manufactured by assembling the tubes and the corrugated ribs to form the desired arrangement in a holder, the tubes are fitted into the tube sheet, and the side parts are added so that the fin-coil block thus formed can be soldered. This type of manufacture is also used for heat exchangers for charge air coolers (German Patent Document DE-OS 23 43 787), in which case however measures are employed to avoid the formation of vapor bubbles in the tubes on the air inlet side, but is relatively expensive.

An object of the present invention is to design a fin-coil block of the species recited at the outset in such form that simpler manufacture is possible.

To achieve this goal, in a fin-tube block of the species recited at the outset, it is proposed that the tubes be made in the form of adjacent channels in plate-shaped extrusion moldings that are stacked on one another, alternating with corrugated ribs and additional extruded sections, in a packet assembly and then assembled to form the fin-tube block.

This design makes it no longer necessary to align the individual tubes with the corrugated ribs. The corrugated ribs and the extruded sections are stacked on top of one another and then soldered as a package using known soldering techniques.

A provision can be made according to preferred embodiments of the invention such that at least two extruded sections are arranged sequentially in the air flow direction and are connected to one another formwise. This measure takes into account that extruded sections cannot be manufactured in all desired widths, so that it becomes necessary to build up a layer of the fin-tube block, composed of extruded sections, from several such extruded sections.

In one advantageous aspect of preferred embodiments of the invention, the extruded sections can be provided with hooks that run parallel to the flow channels and interlock with one another; these hooks advantageously are designed as strips projecting from one side wall to the other, whose grooves are displaced forward to receive the strips of the adjacent extruded section. By virtue of this design, the parts that serve for hooking can also be made integrally with the extruded sections so that when adjacent extruded sections are fitted together, they rest on one another only at their side edges so that the hook strips engage one another.

According to an advantageous feature of the invention, the extruded sections can be made from a metal alloy that can be soldered and in particular can be made of a curable aluminum alloy (AlMgSiO,5). Surprisingly it has been found that extruded sections made from the latter alloy, after their manufacture and after cooling, are subjected to so-called cold curing and increase their strength after a certain period of time.

The extruded sections thus manufactured can be solder-plated, so that they can be soldered in known fashion to the adjoining corrugated ribs to form a fin-tube block.

Other objects, advantages and novel features of the present invention will become apparent from the following detailed description of the invention when considered in conjunction with the accompanying drawings.

BRIEF DESCRIPTION OF THE DRAWINGS

FIG. 3 is an enlarged and schematic view of a part of the section in FIG. 2;

FIG. 4 is a section along line IV—IV in FIG. 3;

FIG. 5 is a view of an embodiment of the extruded section that is modified with respect to FIG. 3 and can be fitted together with an additional extruded section; and FIG. 6 finally is an enlarged view of the connecting point between the two extruded sections shown in FIG. 5.

DETAILED DESCRIPTION OF THE DRAWINGS

Figure 1:
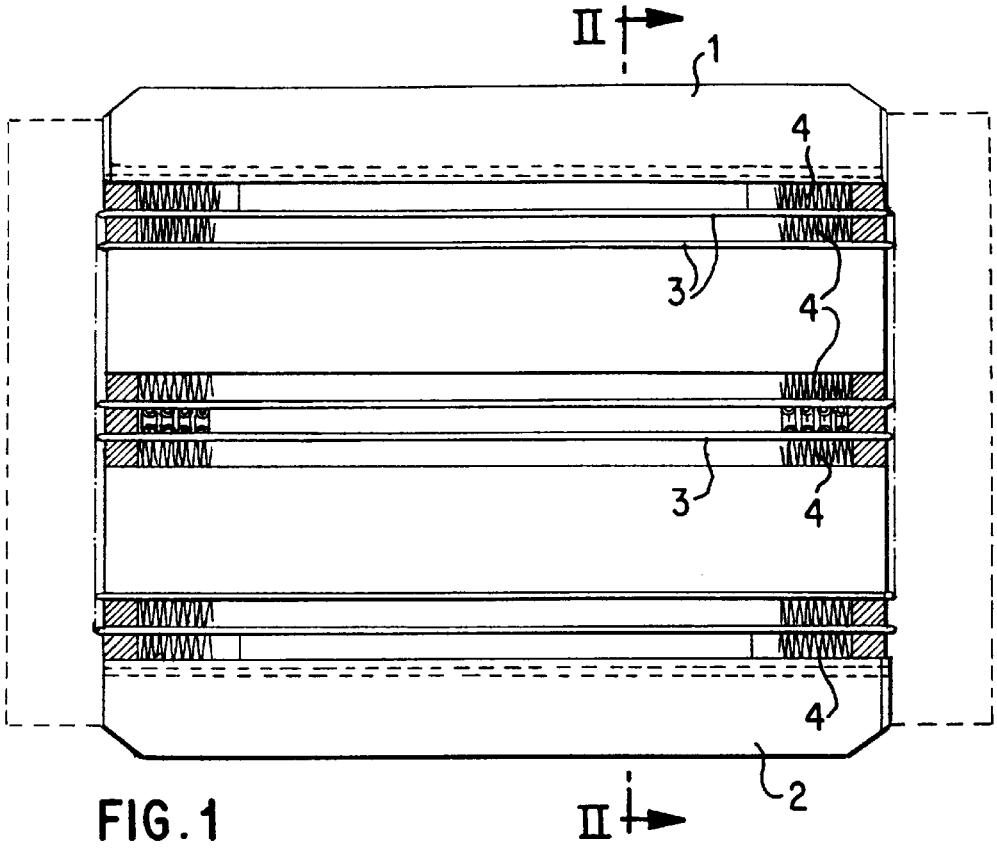
FIG. 1 is a schematic cross section, looking in the air-flow direction through a charge air cooler, constructed according to a preferred embodiment of the present invention.
Figure 2:
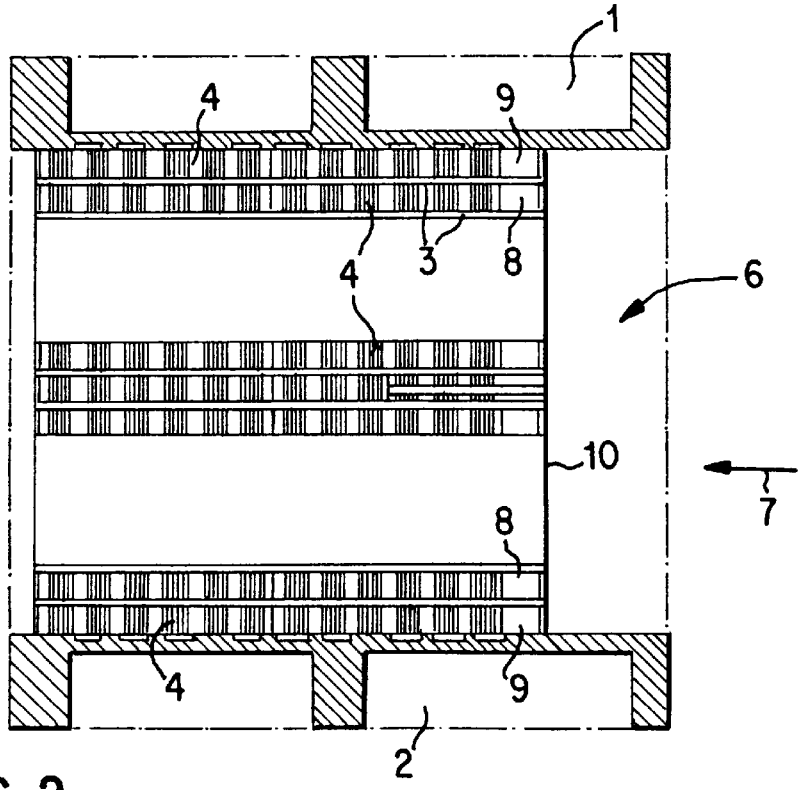
FIG. 2 is a section through the charge air cooler in FIG. 1, taken along section line II—II.

In FIGS. 1 and 2, a fin-tube block is shown for a charge air cooler that includes two side parts 1 and 2 to be joined later with water tanks represented in phantom in FIG. 1, tubes located parallel to these side parts in the form of channels 3, and fin-shaped corrugated ribs 4 provided between the channels 3. Corrugated ribs 4 are likewise provided adjacent to side parts 1 and 2, said ribs being connected by a solder film 13 with side parts 1 and 2.

The charge air cooler is traversed by air in the direction of arrow 7, said air flowing through the corrugated ribs and delivering its heat through the corrugated ribs to channels 3, which, as will be described in greater detail with reference to FIGS. 3 and 4, are designed as adjacent channels in a plate-shaped extruded section 12. Coolant therefore flows at right angles to the through-flow direction 7 of the air, said coolant entering through an inlet chamber 6 that is surrounded by the side parts and by the water tanks and, past leading edge 10 of the fin-tube block, initially flows through sections 8 and 9 of the corrugated ribs between the extruded sections 12. These two sections 8 and 9 can be filled with corrugated ribs with reduced thermal conductivity when used for charge air coolers, so that the heat transfer at the point of highest charge air temperature, which can be 235° C., is slightly worse than in the next area. In this way, the coolant can be prevented from boiling inside channels 3.

FIGS. 3 and 4 show that channels 3 are each part of an extruded section 12 that is provided on at least one side edge with a through hook designed as a strip 14 that has a groove 15 located in front of it. This design serves, as shown in FIG. 3, but especially as shown in FIGS. 5 and 6, for positively fitting together two or more extruded sections. As is readily apparent from FIGS. 3 and 4, the fin-tube block can be produced in simple fashion by applying to an initially horizontally located side part 2, first a thin solder film 13 and then a first layer of corrugated ribs 4, followed by extruded section 12, with second extruded section 12' joined by strip 14, whereupon a layer of corrugated ribs 4, additional extruded sections 12, and the next layer of corrugated ribs 4 are laid down in layers on top of one another packetwise. The packet thus formed is then soldered together so that the fin-tube block is produced without costly aligning work being necessary. Extruded sections 12 and 12' are then solder-plated on both sides so that they can be joined with the adjoining corrugated ribs 4 in known fashion by soldering.

Alternatively, instead of plating, solder films can be provided between the extruded sections and the corrugated ribs.

FIGS. 5 and 6 show extruded sections 12" whose shape has been modified slightly, in which channels 3' each form an oval. The design of engaging strip 14' and the groove 15' located in front of it for accommodating a strip 14' is however the same as in the embodiment shown in FIG. 3. As is readily apparent, the alignment of strips 14' when extruded sections 12" abut one another, as in the case of extruded sections 12 and 12", is reversed in each case so that adjacent extruded sections in air flow direction 7 can be fitted together positively by means of strips 14' and grooves 15' to form a layer. This is especially clear from FIG. 6 which also shows that strips 14' project slightly above the middle of the thickness b of extruded sections 12" from upper outer wall 16 to lower side wall 17 and that consequently groove 15' that is adapted to the shape of strip 14 and is located in front of it, is correspondingly made slightly deeper. Strips 14' and grooves 15' have slightly conically tapering outside walls so that when adjacent extruded sections 12" are fitted together, a form fit is created between grooves 15' and strips 14', locking them together. The extruded sections thus assembled, which have the form of plates, can be applied as a complete plate onto a layer of corrugated rubs 4. Since both outside wall 16 and outside wall 17 are solder-plated or jointed in an alternative design to a solder film, permanent connection with adjacent layers is then made possible.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. Fin-tube block for a charge air cooler, said block being mounted in use in a solid frame that consists of two water tanks and two side parts and comprising:

metal tubes that extend parallel to one another and have open ends surrounded by the tanks, and fin-shaped corrugated metal ribs through which air flows, wherein the tubes are designed as adjacent channels in a plate-shaped extruded metal section that is stacked alternately with said corrugated ribs and additional plate-shaped extruded sections in a packet design and assembled to form the fin-tube block with a layer of said corrugated ribs located between each pair of adjacent extruded sections in said packet, and wherein said plate-shaped extruded sections include parts permitting connection with corresponding parts of further plate-shaped extruded sections in an air flow direction.

2. Fin-tube block according to claim 1, wherein at least two of said plate-shaped extruded sections are located sequentially in said air flow direction and are joined formwise with one another.

3. Fin-tube block according to claim 2, wherein the parts are hooks that extend parallel to said channels and each engage one another.

4. Fin-tube block according to claim 3, wherein the hooks are designed as strips that extend from one side wall of the extruded section toward an opposite side wall of the extruded section, with grooves of said strips being displaced forward to receive the strips of an adjacent extruded section.

5. Fin-tube block according to claim 4, wherein the strips project slightly above a middle of the thickness of the extruded sections.

6. Fin-tube block according to claim 1, wherein the extruded sections are made from a solderable metal alloy.

7. Fin-tube block according to claim 6, wherein the extruded sections consist of a curable Al alloy.

8. Fin-tube block according to claim 6, wherein the extruded sections are solder-plated on both sides.

* * * * *